United States Patent [19]

Leigh

[11] 4,225,452

[45] Sep. 30, 1980

[54] BLEACHING AND CLEANING COMPOSITION

[75] Inventor: Arthur G. Leigh, Wirral, England

[73] Assignee: Lever Brothers Company, New York, N.Y.

[21] Appl. No.: 77,962

[22] Filed: Sep. 24, 1979

[30] Foreign Application Priority Data

Sep. 27, 1978 [GB] United Kingdom ..... 38347/78

[51] Int. Cl.[3] ..... C11D 7/54

[52] U.S. Cl. ..... 252/102; 252/95; 252/99; 252/186; 252/174.16; 252/544; 252/545

[58] Field of Search ..... 252/99, 95, 186, 174.16, 252/544, 545, 102

[56] References Cited

U.S. PATENT DOCUMENTS

| | | | |
|---|---|---|---|
| 3,177,148 | 4/1965 | Bright et al. | 252/99 |
| 3,779,931 | 12/1973 | Fries et al. | 252/99 |
| 4,111,826 | 9/1978 | Leigh et al. | 252/99 X |

*Primary Examiner*—Mayer Weinblatt
*Attorney, Agent, or Firm*—Melvin H. Kurtz

[57] ABSTRACT

An improved bleaching and cleaning composition comprising a percompound and an organic activator therefor having at least one RCON<group in the molecule wherein RCO represents a carboxylic acyl radical, of which the peracid generation and bleaching performance are enhanced by the incorporation therein of a compound selected from the group having the following general formula:

(I)

wherein n=1-4; and X=H or an alkali metal or alkaline earth metal or ammonium cation;

(II)

wherein n=0-2; X=H or an alkali metal or alkaline earth metal or ammonium cation Y=H, $CH_2COOX$ or $CH_2PO_3X_2$ Z=H, $CH_2COOX$ or $CH_2PO_3X_2$ (X=H or an alkali metal or alkaline earth metal or ammonium cation).

(III)

wherein n=1-3; and X=H, an alkali metal, alkaline earth metal or ammonium cation.

5 Claims, 5 Drawing Figures

BLEACHING AND CLEANING COMPOSITION

This invention relates to bleaching and cleaning compositions. More particularly it relates to bleaching and cleaning compositions comprising a percompound and an organic activator for said percompound.

Bleaching compositions containing inorganic percompounds and organic activators thereof, with or without organic detergent substances having a cleaning action and builders, are known in the art. These organic activators are generally carboxylic acid derivatives, e.g. esters (such as those described in British Pat. Nos. 836,988 and 970,950), amides (such as those described in British Pat. Nos. 907,356, 855,735 and 1,246,339), acyl azoles (such as those described in Canadian Pat. No. 844,481), acyl imides (such as those described in South African Pat. No. 68/6,344) and triacylcyanurates (such as those described in U.S. Pat. No. 3,332,882), which react with the inorganic percompound or hydrogen peroxide at relatively low temperatures to form organic peracids, which unlike the inorganic percompounds are effective in bleaching at lower temperatures.

The term "percompound" is used here to indicate those percompounds which liberate active oxygen in solution, e.g. the alkali metal perborates, percarbonates, persilicates and perphosphates.

The low efficiency of peracid generation and bleaching in many of such organic activator/percompound systems has long been recognised as a problem, and research continues in an effort to provide compositions with increased efficiency of peracid generation and enhanced bleaching performance. The compositions of the present invention are the results of such research.

Applicant's own laboratory investigations of activator/percompound bleach systems have revealed that, apart from the primary reaction between the organic activator and the percompound forming the peracid, there are peracid-consuming side reactions taking place in the wash and/or bleaching solution.

It is believed that one reason for the lower efficiency of activator/percompound bleach systems compared with peracids per se is the relative sluggishness of the primary reaction:

$$\text{activator} + \text{percompound} \rightarrow \text{peracid} \qquad (1)$$

This phenomenon is especially observed in the case with N,N,N',N'-tetraacetylethylene diamine and a percompound, such as sodium perborate when used in a cold fill European machine cycle.

An obvious disadvantage of slow peracid formation is the restriction it imposes on the average peracid concentration in the wash. A further and very considerable disadvantage is that it allows peracid-consuming side reactions to become relatively more important. The most damaging of the side reactions is that between peracid and percompound, e.g. sodium perborate or sodium percarbonate, forming useless products, viz. the corresponding carboxylic acid, molecular oxygen and water:

$$\text{peracid} + \text{percompound} \rightarrow (\text{RCOOH}, O_2, H_2O) \qquad (2)$$

This reaction is doubly deleterious since peracid and percompound (which is a source of peracid or, if present in excess of the activator, will provide additional bleaching at higher temperatures) are destroyed simultaneously. Thus under stoichiometric conditions each mole of percompound, e.g. perborate, used up in reaction (2) effectively eliminates two moles of peracid from the system (one directly and one indirectly).

It has now been found that the above deleterious side reactions can be suppressed, thereby enhancing the peracid generation and bleaching performance of activator/percompound systems to a substantial degree, if the system includes a compound selected from the group consisting of compounds having the following general formulae:

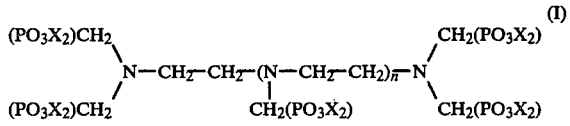

(I)

wherein n=1–4; and X=H or an alkali metal or alkaline earth metal or ammonium cation;

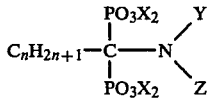

(II)

wherein n=0–2; X=H or an alkali metal or alkaline earth metal or ammonium cation;

Y=H, $CH_2COOX$ or $CH_2PO_3X_2$,

Z=H, $CH_2COOX$ or $CH_2PO_3X_2$, (X=H or an alkali metal or alkaline earth metal or ammonium cation);

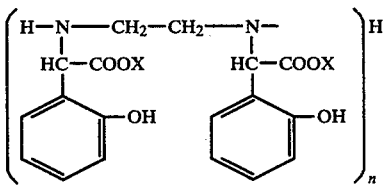

(III)

wherein n=1–3; and X=H or an alkali metal or alkaline earth metal or ammonium cation.

The compounds of above group are known as chelating agents and it is believed that they inhibit the peracid/percompound reaction (2) mentioned above.

An important condition for inhibition to be effective is that it is selective for said reaction (2), as any advantage will be lost if the inhibiting effect extends to the peracid forming reaction (1) and/or the bleaching reactions:

$$\text{peracid} + \text{stain} \rightarrow \text{bleached stain} \qquad (3a)$$

$$\text{percompound} + \text{stain} \rightarrow \text{bleached stain} \qquad (3b)$$

It has been found that the compounds of the above-mentioned group are selective for inhibiting reaction (2), resulting in a substantial improvement in the bleaching action of percompound/bleach activator systems.

Although the invention is applicable to any type of organic activator having a carboxylic acyl group, the invention excludes the use of organic activators which form with the percompound in solution a peracid having a double bond between the carbon atoms in the $\alpha,\alpha'$ position to the carbonyl groups of the corresponding anhydride ring, such as phthalic anhydride, in view of their instability.

The invention is particularly applicable to those activators having at least one RCON< group in the molecule of which RCO represents a carboxylic acyl radical.

Accordingly the invention provides a bleaching and cleaning composition comprising a percompound, an organic activator therefor having at least one RCON< group in the molecule wherein RCO represents a carboxylic acyl radical, and a compound selected from the group having the following general formulae:

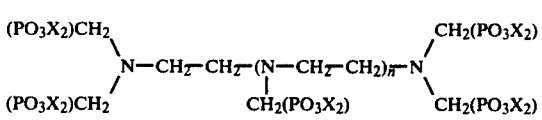

(I)

wherein n = 1-4; and X = H or an alkali metal or alkaline earth metal or ammonium cation;

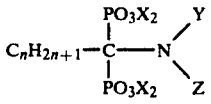

(II)

wherein n = 0-2; X = H or an alkali metal or alkaline earth metal or ammonium cation, Y = H, $CH_2COOX$ or $CH_2PO_3X_2$ Z = H, $CH_2COOX$ or $CH_2PO_3X_2$ (X being H or an alkali metal or alkaline earth metal or ammonium cation);

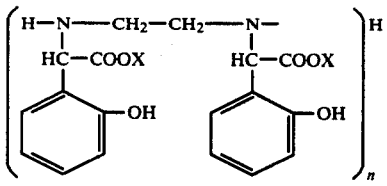

(III)

wherein n = 1-3; and X = H or an alkali metal or alkaline earth metal or ammonium cation.

Enhanced bleaching action can be observed already with relatively small amounts of the said chelating agents of formulae (I), (II), (III). Generally it can be said that the presence of said chelating agents in proportions of about 0.05-5.0% by weight in the composition comprising a percompound and an organic activator of the type as used in the present invention will be sufficient to give improved bleaching effect. A preferred range will be from 0.1-2.0% by weight, based on the total composition.

Preferred chelating agents for use in the present invention are:

of group (I):

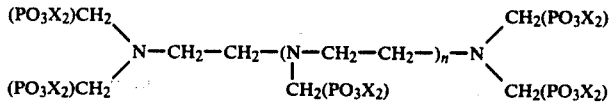

wherein n = 1-2; and X = H or an alkali metal or alkaline earth metal cation, e.g. diethylene triamine penta(methylene phosphonic acid)—(Ia)

triethylene tetramine hexa(methylene phosphonic acid)—(Ib)

of group (II):

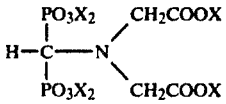

(IIa)

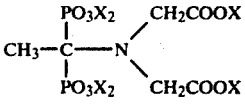

(IIb)

wherein X = H or an alkali metal cation of group (III):

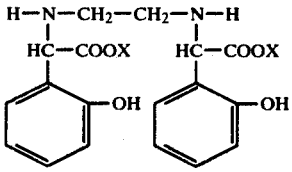

(IIIa)

wherein X = H or an alkali metal cation.

In contrast therewith, other chelating agents most commonly known and used in the art, some of them having a similar or analogous structure as the effective compounds used in the present invention, such as:

ethylene diamine tetraacetic acid—Na salt (EDTA)

nitrilotriacetic acid—Na salt (NTA)

ethane 1-hydroxy 1,1'-diphosphonic acid—Na salt (EHDP)

amino tri-(methylene phosphonic acid)—Na salt (ATMP)

diethylene triamine penta acetic acid—Na salt (DETPA)

are substantially ineffective and do not give improved bleaching, although their presence will not adversely affect the inhibiting effect of the selected chelating agents of formulae (I), (II) and (III) on the peracid/percompound reaction. The composition of the invention may therefore contain as desired any other chelating agents in addition to the chelating agents of formulae (I), (II) and (III).

The percompounds which may be used in conjunction with the activator in the present invention include hydrogen peroxide and its derivatives, such as alkali metal peroxides and superoxides, perborates, persulphates, persilicates, percarbonates, perpyrophosphates and urea peroxide. The inorganic percompounds, especially perborates and percarbonates, are preferred because of their commercial availability.

The activators used, which have at least one RCON< group in the molecule, wherein RCO represents a carboxylic acid radical, are well-known in the art (and discussed in the patent specifications and publications cited above). Especially suitable are those compounds in which the acyl group is acetyl or benzoyl or substituted benzoyl, particularly acetyl, e.g. N,N,N',N'-tetraacetylethylene diamine (TAED); tetraacetylglycoluril (TAGU); and tetraacetylmethylene diamine (TAMD), α-acetoxy-(N,N')-diacetylmalonamide.

The ratio between percompound and activator can be varied widely and a satisfactory bleaching performance can be obtained at molar ratios of percompound to activator ranging from 0.5:1 up to about 35:1.

The bleaching and cleaning composition of the invention can further contain in addition thereto any other ingredients and/or additives which are generally incorporated into bleaching and detergent compositions. Surface-active agents such as anionic, nonionic, ampholytic and zwitterionic detergents, organic and inorganic builders, suds depressors and suds boosters, enzymes, antiflocculating agents, optical brighteners, dyes and perfumes are examples of the ingredients that can be incorporated, most of which are used in varying quantities in bleaching and detergent compositions.

The bleaching and detergent compositions of the present invention can contain up to 50%, preferably from 5% to 30% of organic detergent active materials. Suitable detergent active materials include: water-soluble anionic soap and non-soap detergents, nonionic synthetic detergents, zwitterionic synthetic detergents and ampholytic synthetic detergents. Mixtures of such detergents are also frequently used.

The anionic detergents include soaps which can be derived from natural or synthetic fatty acids. Natural fatty acids are frequently more or less unsaturated, but can be hydrogenated to a well-defined iodine value before being converted into the water-soluble salts. Well-known examples are the sodium, potassium, ammonium and alkanol ammonium salts of higher fatty acids, e.g. $C_{10}$ to $C_{22}$ fatty acids, and particularly, the sodium and potassium soaps derived from tallow and coconut fatty acids.

As anionic synthetic detergents, there can be used, for example, the water-soluble salts of organic sulphuric acid reaction products containing an alkyl radical with from 8 to 22 carbon atoms. Examples thereof are: the sodium alkyl sulphates derived from tallow or coconut oil, sodium alkyl benzene sulphonates, sodium alkyl glyceryl ether sulphonates, sodium coconut oil fatty acid monoglyceride sulphonates and sulphates, sodium alkane sulphonates having from 10 to 20 carbon atoms in the alkyl chain and sodium salts of hydroxy alkane sulphonates, hydroxy alkene sulphonates and alkene sulphonates, these latter being derived from olefins, preferably having from 12 to 18 carbon atoms in the hydrocarbon chain, through sulphonation with sulphur trioxide followed by an alkaline hydrolysis of the sulphonation products obtained. The detergent sulphates derived from esters of the reaction product of one mole of a higher fatty alcohol with from 1 to 6 moles of ethylene oxide, are also acceptable. Other possible surfactants include the alkaline salts of alkyl or alkyl phenol ethylene oxide ether sulphates or sulphonates with from 1 to 10 units of ethylene oxide per molecule, and wherein the alkyl radical contains from 8 to 18 carbon atoms; the reaction products of fatty acids esterified with isethionic acid and neutralised with sodium hydroxide, sodium or potassium salts of fatty acid amine of a methyl taurine.

The nonionic synthetic detergents which can effectively be used are characterised by the presence of an organic hydrophilic and an organic hydrophobic group. The hydrophilic character of these compounds is mostly due to the presence of alkylene oxide chains, amine oxide, sulphoxide and phosphine oxide radicals. Typical hydrophobic groups include: condensation products of propylene oxide with propylene glycol, alkyl phenols, condensation products of propylene oxide and ethylene diamine, aliphatic alcohols having from 8 to 22 carbon atoms and fatty acid amides.

A well-known nonionic detergent is commercially available under the trade name "PLURONICS" (Registered Trade Mark). It may be represented as the condensation product of ethylene oxide with propylene glycols. Its water-solubility can be varied depending upon the ratio of these compounds.

Examples of other nonionics include: the amine oxides, phosphine oxides and sulphoxides having semipolar characteristics. Long chain tertiary amine oxides such as dimethyldodecylamine oxide are representatives of these classes. Suitable phosphine oxides are disclosed in U.S. Pat. No. 3,304,263, and include: dimethyldodecyl phosphine oxide and dimethyl-(2-hydroxydodecyl)phosphine oxide. The suitable long chain sulphoxides correspond to the formula:

$$R_1-\overset{\overset{\displaystyle O}{\|}}{S}-R_2$$

wherein $R_1$ and $R_2$ are substituted or unsubstituted alkyl radicals, the former containing from 10 to 28 carbon atoms, and $R_2$ containing from 1 to 3 carbon atoms. Specific examples of these sulphoxides are: dodecyl methyl sulphoxide and 3-hydroxy tridecyl methyl sulphoxide.

Ampholytic and zwitterionic synthetic detergents can also be used. Examples of ampholytic synthetic detergents are: sodium 3-dodecylamino propionate and sodium 3-dodecylaminopropane sulphonate. Useful zwitterionic synthetic detergents are: 3-(N,N-dimethyl-N-hexadecylammonium)propane-1-sulphonate and 3-(N,N-dimethyl-N-hexadecylammonium)-2-hydroxy propane-1-sulphonate.

The alkaline detergency builders can be employed in an amount up to about 80% by weight in the compositions of the present invention in a weight ratio of organic detergent to alkaline builder within the range from 10:1 to 1:30, preferably from 5:1 to 1:20. The builders can be inorganic or organic by nature, and can be selected from a wide variety of known builder materials. Useful alkaline inorganic builders are: alkali metal carbonates, phosphates, polyphosphates and silicates. Specific examples of such salts are: sodium and potassium triphosphates, carbonates, pyrophosphates, orthophosphates and hexamethaphosphates. Useful alkaline organic builders are alkali metal, ammonium and substituted ammonium polycarboxylates, for example polyacetates, citrates, tartrates, malates, oxydiacetates, alkenyl succinates, carboxymethyloxy succinates, oxydisuccinates and sulphonated fatty acid salts.

The polycarboxylate builder salts useful herein consist of water-soluble salts of polymeric aliphatic polycarboxylic acids of the type described in U.S. Pat. No. 3,308,067. Examples include the water-soluble salts of polymers of itaconic acid, maleic acid, fumaric acid and mesaconic acid.

The compositions according to this invention can also contain enzymes, which aid and augment the cleaning and soil removal performance of the compositions, due to their capability of hydrolyzing, and thus rendering more soluble, the soil. Owing to the specific activity of an enzyme preparation, it is preferable to add mixtures of different enzymes containing at least proteases and/or amylases, the ratio of these being varied according to the expected soil compositions, Lipases and other soil-hydrolyzing enzymes can also be added. Usually, from 0.01 to 5, preferably from 0.2 to 2% by weight of enzymes can be incorporated into the bleaching and detergent compositions. It may also be advantageous to add some stabilizing agents for the enzymatic activity during prolonged storage. The usual activators for the enzymatic activity can also be added.

The compositions of this invention can contain a certain amount of humidity, brighteners, hydrotropes, perfumes, germicides, dyes and other additives in minor amounts.

An example of a more specific composition of the present invention comprises from 5% up to 30% by weight of percompound, from 0.5% up to 15% by weight of an organic activator and up to 2.0% by weight of the chelating agent of formulae (I), (II) or (III), and all or some of the following: up to 40% by weight of a surface-active detergent or a mixture of surface active detergents, up to 60% by weight of a detergency builder whereby at least part of said builder is alkaline, the proportion of said detergent to said builder being in the range from 10:1 to 1:30; up to 5% by weight of a proteolytic, lipolytic or amylolytic enzyme, or mixtures thereof, and up to 20% by weight of minor additives selected from soil-suspending agents, brighteners, perfumes, dyes and anti-tarnishing agents and/or humidity.

In the above composition, the amount of surface-active detergent or mixture of surface-active detergents present is preferably from 5 to 30% by weight and the amount of detergency builder present is preferably from 20% to 50% by weight.

The following Examples illustrate the invention.

EXAMPLE 1

The following detergent powder compositions were prepared by conventional spray-drying:

| Composition | % by weight (A) |
|---|---|
| sodium dodecylbenzene sulphonate | 7.5 |
| $C_{13}$—$C_{15}$ alcohol/7 ethylene oxide | 5.0 |
| tallow soap | 11.0 |
| sodium triphosphate | 42.0 |
| alkaline sodium silicate | 11.0 |
| sodium carboxymethylcellulose | 0.75 |
| Na-ethylenediamine tetraacetate (EDTA) | 0.15 |
| sodium sulphate | 10.6 |
| water | 12.0 |
| | 100.0 |

| Composition | % by weight (B) |
|---|---|
| composition (A) | 75.0 |
| sodium sulphate | 11.4 |
| sodium perborate | 9.1 |
| N,N,N',N'tetraacetylethylene diamine (TAED) | 4.5 |
| | 100.0 |

| Composition | (C) | (C') |
|---|---|---|
| composition (B) | 99.8 | 99.5 |
| chelating agent (formula Ia) | 0.2 | 0.5 |
| | 100.0 | 100.0 |

| Composition | (D) | (D') |
|---|---|---|
| composition (B) | 99.8 | 99.5 |
| EDTA | 0.2 | 0.5 |
| | 100.0 | 100.0 |

Bleaching tests were carried out with standard tea-stained test swatches using the above compositions in a 60-minute heat-up Tergotometer wash to 95° C. Each composition was used at a dosage of 5 g/l in 24° hard water.

The bleaching results, given as a function of time/temperature in FIGS. 1 and 2, clearly show the enhanced bleaching effect of compositions (C) and (C') of the invention. No enhanced bleaching effect was observed with compositions (D) and (D') containing an extra amount of a conventional chelating agent EDTA (see curves D and D').

EXAMPLES II

In the following experiments composition (B) of Example I was used, to which there were added chelating agents of formulae IIa and IIb at various levels.

The effects were studied in a 60-minute heat-up wash to 95° C., carried out in the Tergotometer of standard tea-stained test swatches. Each composition was used at a dosage of 5 g/l in 24° hard water. The results are given in FIGS. 3, 4 and 5.

EXAMPLE III

Figure 1:
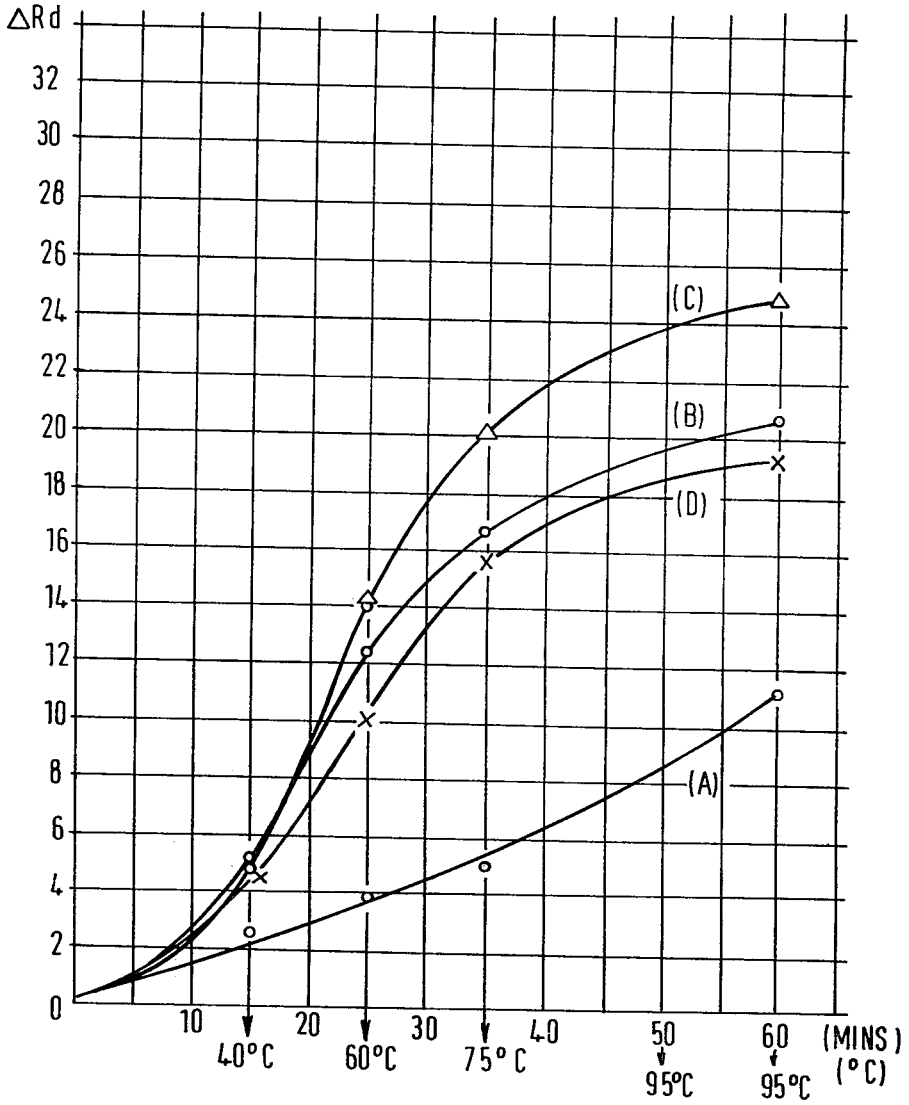
Figure 2:
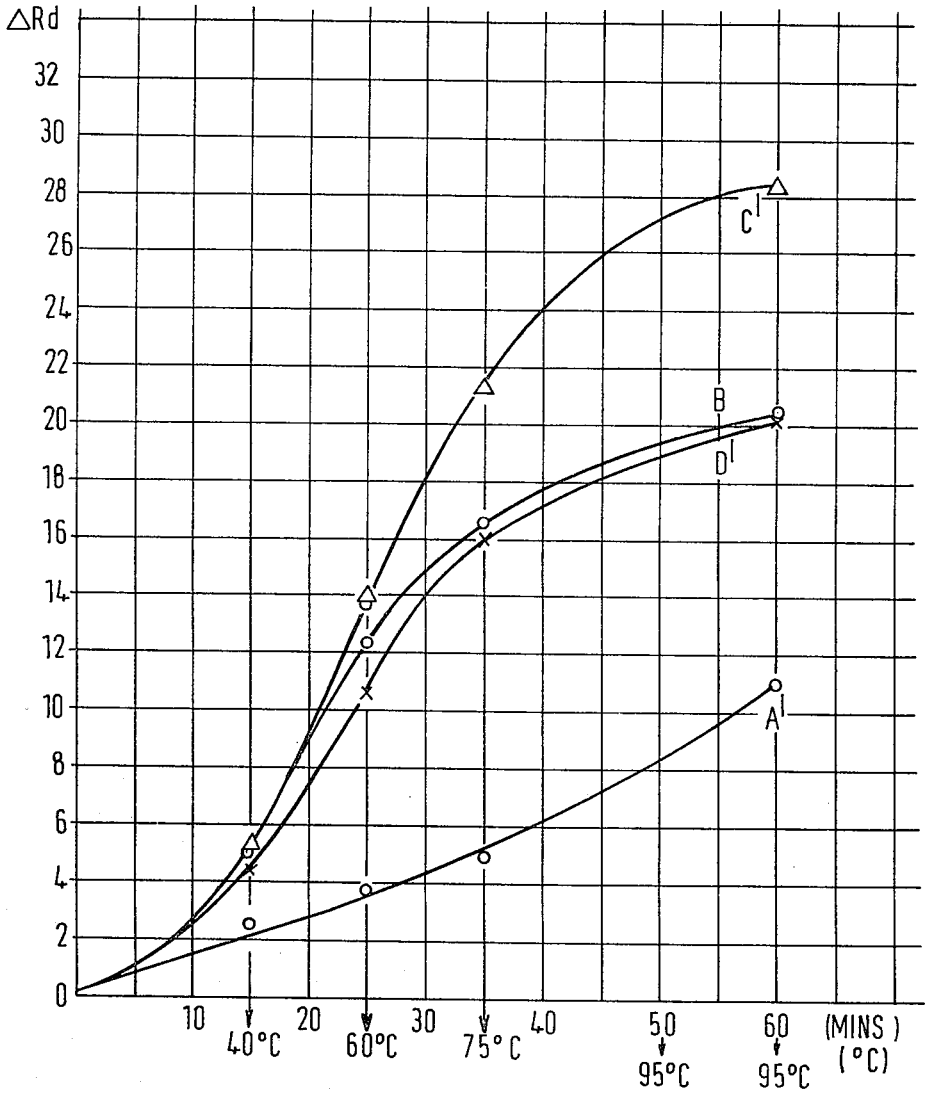
Figure 3:
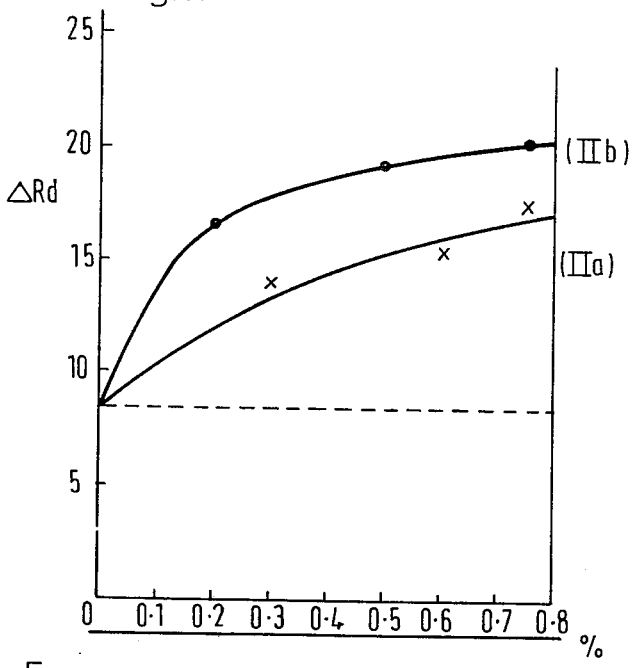
FIG. 3 shows the improvement in bleaching action ($\Delta Rd$) achieved as a function of chelating agent level in the composition ($\Delta Rd = \Delta R460$ (test composition) - $\Delta R460$ (composition A, without bleach).).
Figure 5:
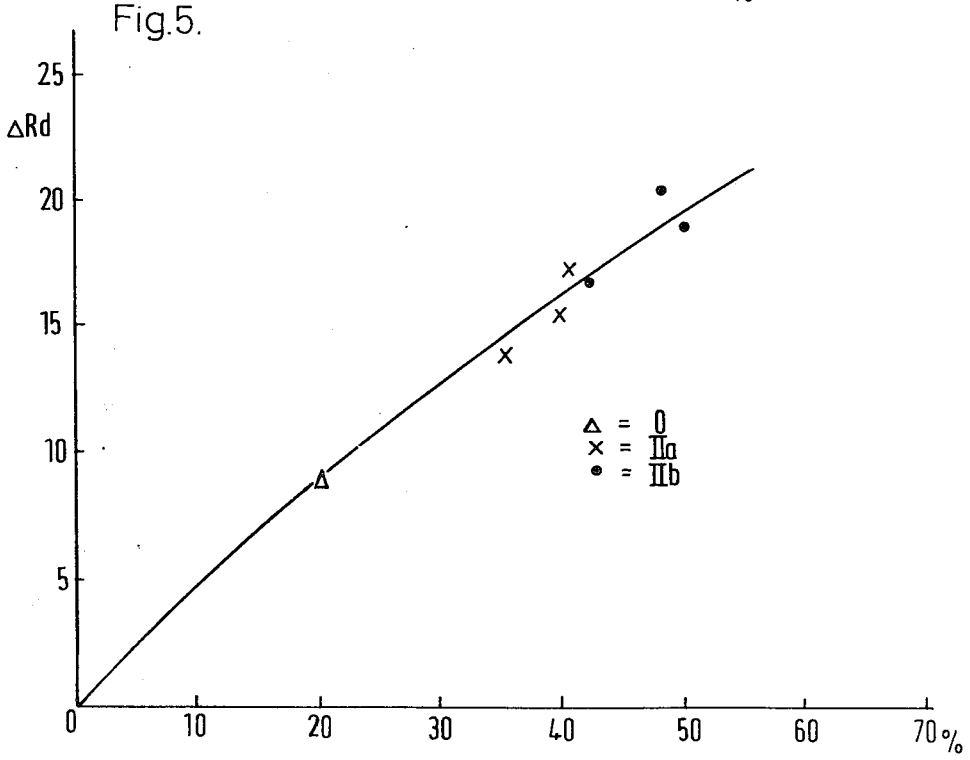
FIG. 5 shows bleaching effect vs. total peroxide concentration in % taken over the whole wash period, the results being taken over the whole wash period, the results being taken from the various systems examined. A smooth (almost linear) relationship was obtained, confirming that inhibition results directly in a bleaching effect.
Figure 4:
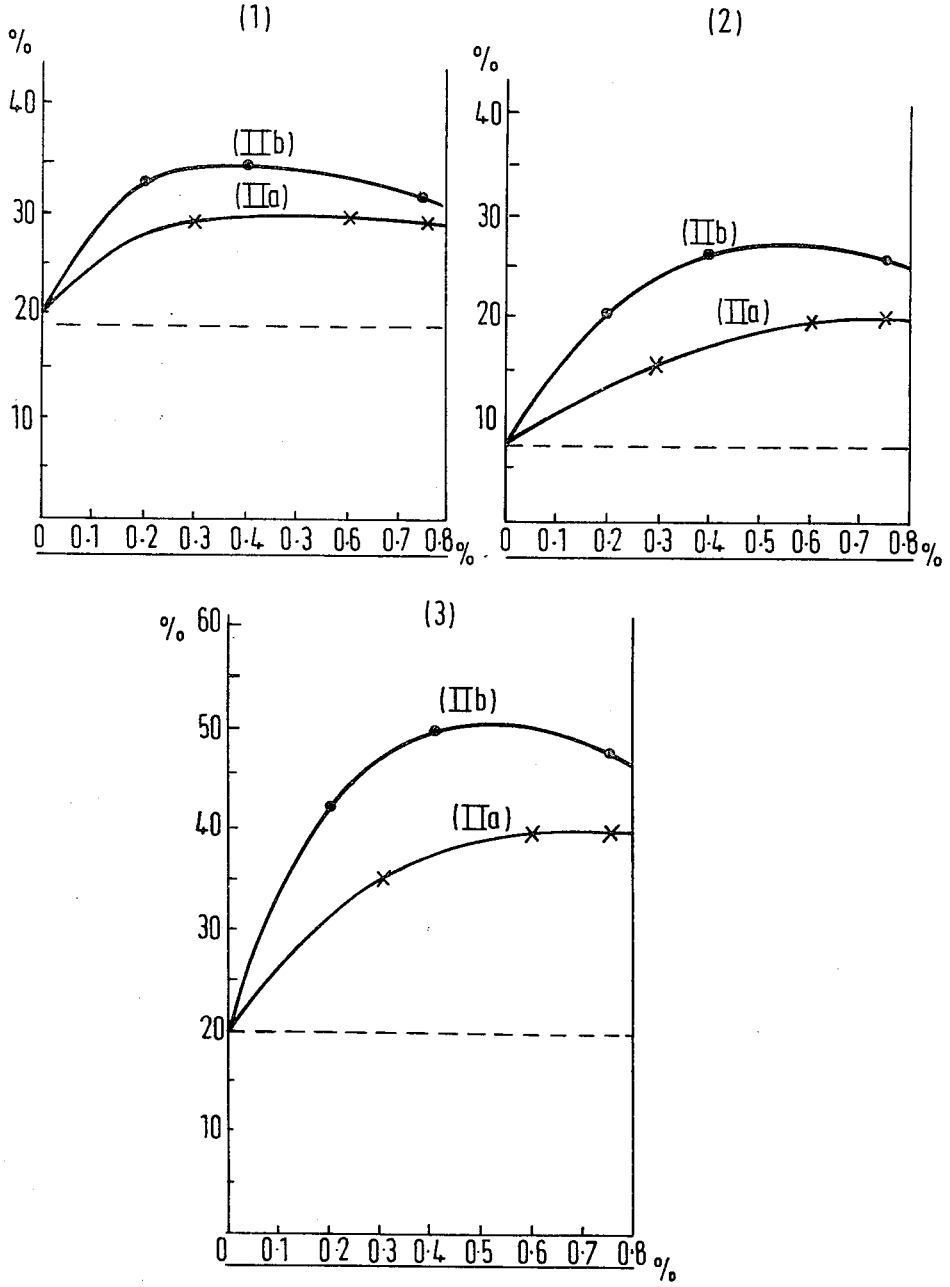
FIG. 4 shows (1) average peracid, (2) perborate and (3) total peroxide concentration, expressed as % of theoretical maximum taken over the whole wash period, plotted against chelating agent level.

The following composition was prepared:

| | % by weight |
|---|---|
| sodium dodecylbenzenesulphonate | 15.0 |
| coconut fatty acid ethanolamide | 2.0 |
| sodium triphosphate | 32.0 |
| alkaline sodiumsilicate | 8.0 |
| sodium carboxymethylcellulose | 0.35 |
| Na-ethylene diamine tetraacetate (EDTA) | 0.13 |
| N,N,N',N'-tetraacetylethylene diamine (TAED) | 4.5 |
| sodium perborate | 9.1 |
| sodium sulphate | 28.42 |
| chelating agent additive | 0.5 |
| | 100.00 |

Comparisons were made between compositions containing the following chelating agents as additive:

none diethylene triamine penta acetic acid—Na salt (DETPA)

compound of formula IIIa, in a 30-minute 60° C. wash in the Tergotometer under the following test-conditions:

Dosage: 4 g/l

Water hardness: 24°.

Bleaching effects were also measured at the completion of the wash.

The results are given in the following Table 1.

TABLE 1

Average peracid, perborate and total peroxide concentrations expressed in mol/1×10³ over the whole wash period together with bleaching effect at the end of the 30-minute period wash. (The figures in parentheses show concentrations expressed as % of theoretical maxima.)

| Additive | Av. peracid concentration mol/1 × 10³ | Av. perborate concentration mol/1 × 10³ | Av. total peroxide concentration mol/1 × 10³ | Bleaching effect (ΔRd) |
|---|---|---|---|---|
| none | 0.104 (6.6) | 0.386 (15.6) | 0.472 (20.0) | 5.9 |
| DETPA | 0.136 (8.6) | 0.471 (19.9) | 0.607 (25.7) | 6.6 |
| Formula IIIa | 0.897 (56.9) | 1.087 (46.0) | 1.984 (84.0) | 13.6 |

From the above results it is clear that use of the chelating agent IIIa according to the invention provides an effective bleaching improvement, virtually eliminating peracid/perborate mutual decompositions, whereas the use of DETPA, like its lower homologue EDTA, is almost ineffective.

EXAMPLE IV

The following composition was prepared by conventional spray-drying and dry-mixing the bleach components:

| | % by weight |
|---|---|
| sodium dodecylbenzene sulphonate | 6.0 |
| $C_{13-15}$ alcohol/7 ethylene oxide | 7.0 |
| sodium triphosphate | 41.0 |
| alkaline sodium silicate | 4.8 |
| sodium carboxymethylcellulose | 1.0 |
| Na-ethylene diamine tetraacetate (EDTA) | 0.2 |
| sodium sulphate | 13.9 |
| N,N,N',N'-tetraacetylethylene diamine (TAED) | 4.5 |
| sodium perborate | 9.1 |
| water | 12.5 |
| | 100.00 |

Washing/bleaching experiments were carried out using the above composition, to which were added 0% extra additive, 1.5% EDTA; 0.35, 0.70% and 1.10% of compound (Ib). The samples were tested in a heat-up wash to 95° C. in the Tergotometer at a dosage of 5 g/l.

The results are given in Table 2 below, showing average peracid, perborate and total peroxide concentrations determined over the whole wash/bleach period (figures in parentheses show average concentrations expressed as % of the theoretical maxima) and also the bleaching effects (ΔR) at the end of the wash and the increase in bleaching attributable to the additive (Δ(ΔR) in the last column.

Table 2

| Additive | Av. peracid concentration (mol/1 × 10³) | Av. perborate concentration (mol/1 × 10³) | Av. total peroxide concentration (mol/1 × 10³) | ΔR | Δ(ΔR) |
|---|---|---|---|---|---|
| — | 0.481 (24.4) | 0.355 (12.0) | 0.836 (28.3) | 13.4 | — |
| 1.5% EDTA | 0.467 (23.6) | 0.391 (13.2) | 0.858 (29.0) | 13.4 | 0.0 |
| 0.35% (Ib) | 0.556 (28.3) | 0.818 (27.7) | 1.374 (46.5) | 17.3 | 3.9 |
| 0.70% (Ib) | 0.569 (28.8) | 1.083 (36.7) | 1.652 (55.9) | 20.4 | 7.0 |
| 1.10% (Ib) | 0.567 (28.7) | 1.262 (42.7) | 1.829 (61.9) | 21.9 | 8.5 |

The above results show that compound (Ib) used in the present invention inhibits the peracid/perborate mutual decomposition, thereby improving both the residual bleach level and the bleach effect of compositions containing sodium perborate and the organic activator TAED.

The ineffectiveness of the chelating agent EDTA as inhibitor and/or bleach booster is again confirmed.

What is claimed is:

1. A bleaching and cleaning composition comprising a percompound which liberates active oxygen in solution, an organic activator therefor having at least one RCON< group in the molecule wherein RCO represents a carboxylic acyl radical, at a molar ratio of percompound to activator of from 0.5:1 to about 35:1, and a compound selected from the group of compounds having the general formulae:

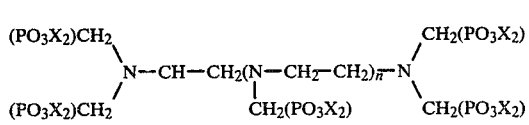

(I)

wherein n=1–4; and X is H or an alkali metal or alkaline earth metal or ammonium cation;

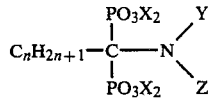

(II)

wherein n=0–2; X is H or an alkali metal or alkaline earth metal or ammonium cation, Y=H, $CH_2COOX$ or $CH_2PO_3X_2$ Z=H, $CH_2COOX$ or $CH_2PO_3X_2$ (X is H or an alkali metal or alkaline earth metal or ammonium cation)

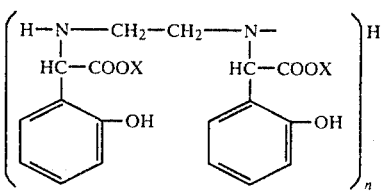

(III)

wherein n = 1–3; and X is H or an alkali metal or alkaline earth metal or ammonium cation, in a proportion of 0.05 to 5.0% by weight and optionally from 0–50% by weight of a surface-active detergent, selected from the group consisting of anionic, nonionic, ampholytic and zwitterionic detergents, and from 0–80% by weight of a detergency builder.

2. A bleaching and cleaning composition according to claim 1, wherein the compound is selected from the group of compounds having the general formulae:

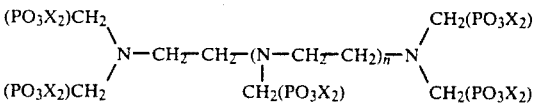

(I)

wherein n = 1–2; X is H, or an alkali metal or alkaline earth metal cation,

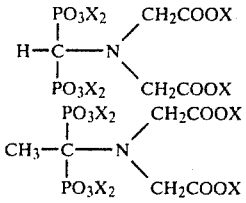

(IIa)

(IIb)

wherein X is H or an alkali metal cation,

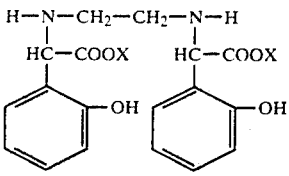

(III)

wherein X is H or an alkali metal cation.

3. A bleaching and cleaning composition according to claim 1, wherein the percompound is an inorganic percompound selected from the group consisting of alkali metal perborates and percarbonates and mixtures thereof.

4. A bleaching and cleaning composition according to claim 1, wherein the organic activator is N,N,N′,N′-tetraacetylethylene diamine.

5. A bleaching and cleaning composition according to claim 1, comprising:

(a) 5 to 30% by weight of surface-active detergent;
(b) 20 to 50% by weight of detergency builder;
(c) 5 to 30% by weight of percompound;
(d) 0.5 to 15% by weight of organic activator; and
(e) 0.1 to 20% by weight of the compound of formulae (I), (II) or (III).

* * * * *